US008909076B2

(12) United States Patent
Uno

(10) Patent No.: US 8,909,076 B2
(45) Date of Patent: Dec. 9, 2014

(54) IMAGE FORMING APPARATUS

(71) Applicant: KYOCERA Document Solutions Inc., Osaka-shi, Osaka (JP)

(72) Inventor: Koji Uno, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/084,421

(22) Filed: Nov. 19, 2013

(65) Prior Publication Data

US 2014/0153939 A1 Jun. 5, 2014

(30) Foreign Application Priority Data

Nov. 30, 2012 (JP) ..... 2012-261968

(51) Int. Cl.
*G03G 21/00* (2006.01)
*G03G 21/10* (2006.01)
*G03G 15/00* (2006.01)

(52) U.S. Cl.
CPC ..... *G03G 21/105* (2013.01); *G03G 15/50* (2013.01)
USPC ..... 399/34

(58) Field of Classification Search
USPC ..... 399/34
See application file for complete search history.

(56) References Cited

U.S. PATENT DOCUMENTS 6,167,211 A * 12/2000 Oogi et al. ..... 399/53
2011/0243579 A1* 10/2011 Oshikawa et al. ..... 399/12

FOREIGN PATENT DOCUMENTS

JP 2008203511 A 9/2008

* cited by examiner

*Primary Examiner* — Clayton E Laballe
*Assistant Examiner* — Linda B Smith
(74) *Attorney, Agent, or Firm* — Alleman Hall McCoy Russell & Tuttle LLP

(57) ABSTRACT

An image forming apparatus includes image forming portion, toner-disposal container, conveying portion, driving portion, load detection portion, image formation control portion, and image forming condition adjustment portion. The image forming condition adjustment portion corrects, when image forming condition does not conform to predetermined condition, the image forming condition. In a case where a drive load detected by the load detection portion becomes greater than first threshold value while the conveying portion is driven by the driving portion and the image forming operation is executed, the image formation control portion temporarily stops the image forming operation, and causes the image forming condition adjustment portion to check and correct the image forming condition. The image formation control portion restarts the image forming operation when, according to the image forming condition having been corrected, the drive load becomes less than second threshold value which is less than first threshold value.

18 Claims, 13 Drawing Sheets

IMAGE FORMING APPARATUS

INCORPORATION BY REFERENCE

This application is based upon and claims the benefit of priority from the corresponding Japanese Patent Application No. 2012-261968 filed on Nov. 30, 2012, the entire contents of which are incorporated herein by reference.

BACKGROUND

The present disclosure relates to image forming apparatuses that include conveying portions in which toner to be discarded is conveyed.

In conventional arts, image forming apparatuses that form toner images on sheets include collecting devices that collect toner to be discarded. The collecting device includes a conveying portion and a collecting container. Toner, to be discarded, generated in units of the image forming apparatus is conveyed to the collecting container by the conveying portion. The conveying portion includes a screw member which is rotated, and conveys, in a predetermined conveying path, the toner to be discarded. A conveying capability of the conveying portion is limited. Therefore, if a great amount of toner to be discarded is conveyed by the conveying portion, load on the screw member becomes excessively heavy, and the screw member may be damaged. Therefore, a technique is known in which, when the screw member indicates an abnormal torque value, the apparatus is stopped as immediately as possible, and a warning is issued to a user.

However, stopping of the image forming apparatus is inconvenient for a user, and it is desired that an image forming operation is performed as continuously as possible. In order to address this, a technique is known in which, when load on the conveying portion becomes excessively heavy, restoration of an operation of the conveying portion is executed. Specifically, even in a case where toner to be discarded is accumulated in the conveying path, and load on the conveying portion is increased, if the conveying path is not full of the toner to be discarded, the conveying portion is continuously driven. Due to the forced driving of the conveying portion, the accumulated toner to be discarded is dispersed, thereby restoring a torque of the conveying portion.

SUMMARY

An image forming apparatus according to one aspect of the present disclosure includes an image forming portion, a toner-disposal container, a conveying portion, a driving portion, a load detection portion, an image forming condition adjustment portion, and an image formation control portion. The image forming portion is an image forming portion that executes an image forming operation on a sheet, and includes: an image carrier on which a toner image is carried; a transfer portion which transfers the toner image to a sheet; and a cleaning portion which cleans the image carrier to remove toner being left on the image carrier after transfer. The toner-disposal container stores the toner to be discarded. The conveying portion conveys the toner to be discarded, from the cleaning portion, to the toner-disposal container. The driving portion drives the conveying portion. The load detection portion detects a drive load on the driving portion. The image forming condition adjustment portion checks an image forming condition of the image forming operation, and corrects, when the image forming condition does not conform to a predetermined condition, the image forming condition. The image formation control portion controls the driving portion and the image forming operation. In a case where the drive load detected by the load detection portion becomes greater than a first threshold value while the conveying portion is driven by the driving portion and the image forming operation is executed, the image formation control portion temporarily stops the image forming operation, and causes the image forming condition adjustment portion to check and correct the image forming condition. Thereafter, the image formation control portion restarts the image forming operation when, according to the image forming condition having been corrected, the drive load becomes less than a second threshold value which is less than the first threshold value.

An image forming apparatus according to another aspect of the present disclosure includes an image forming portion, a toner-disposal container, a conveying portion, a driving portion, a load detection portion, an image forming condition adjustment portion, and an image formation control portion. The image forming portion is an image forming portion that executes an image forming operation on a sheet, and includes: an image carrier on which a toner image is carried; a transfer portion which transfers the toner image to a sheet; and a cleaning portion which cleans the image carrier to remove toner being left on the image carrier after transfer. The toner-disposal container stores the toner to be discarded. The conveying portion conveys the toner to be discarded, from the cleaning portion, to the toner-disposal container. The driving portion drives the conveying portion. The load detection portion detects a drive load on the driving portion. The image forming condition adjustment portion checks an image forming condition of the image forming operation, and corrects, when the image forming condition does not conform to a predetermined condition, the image forming condition. The image formation control portion controls the driving portion and the image forming operation. In a case where the drive load detected by the load detection portion becomes greater than a first threshold value while the conveying portion is driven by the driving portion and the image forming operation is executed, the image formation control portion temporarily stops the image forming operation, and causes the image forming condition adjustment portion to check the image forming condition. Thereafter, the image formation control portion restarts the image forming operation when the image forming condition has been corrected.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described in detail with reference to the drawings. The present disclosure is applicable to image forming apparatuses that use electrophotography and include intermediate transfer belts. Examples of such an image forming apparatus include copy machines, printers, facsimile apparatuses, or multifunction peripherals having a portion or the entirety of functions of these apparatuses and machines.

Figure 1:
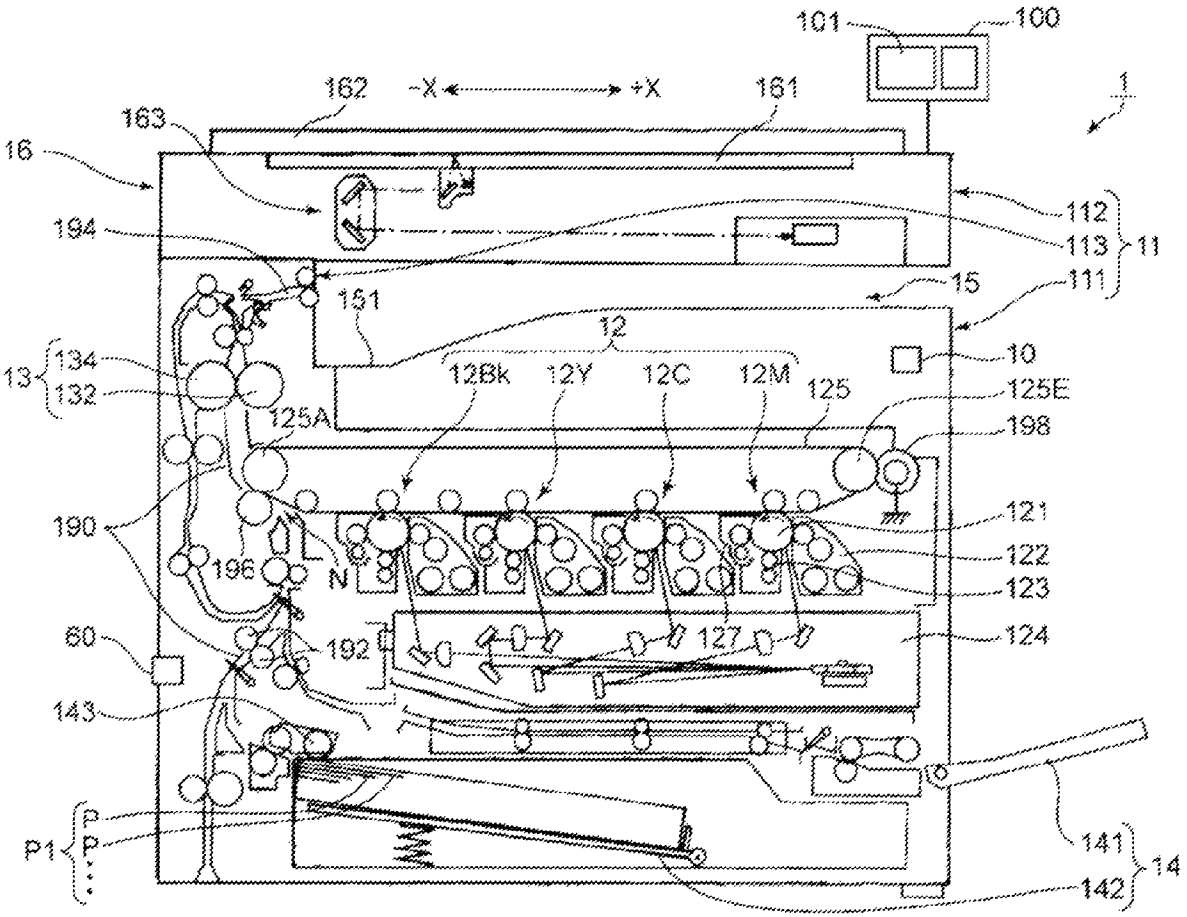
FIG. 1 is a cross-sectional view of a structure of an image forming apparatus, as viewed from the front thereof, according to one embodiment of the present disclosure.
Figure 2:
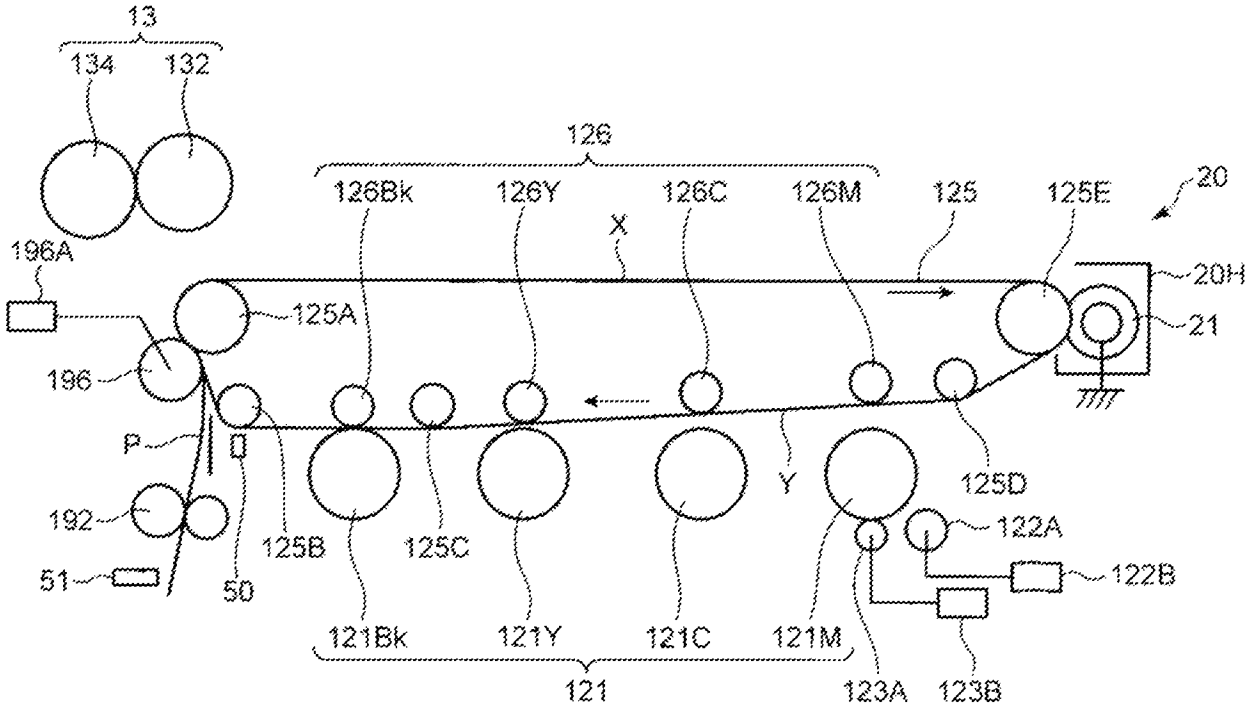
FIG. 2 is a cross-sectional view illustrating a structure of a region near an intermediate transfer belt of the image forming apparatus according to one embodiment of the present disclosure.

FIG. 1 is a cross-sectional view of a structure of an image forming apparatus 1, as viewed from the front thereof, according to one embodiment of the present disclosure. FIG. 2 illustrates a cross-sectional structure of a region near an intermediate transfer belt 125 according to the present embodiment. The image forming apparatus 1 includes an image forming portion 12, a fixing device 13, a sheet feed portion 14, a paper sheet discharge portion 15, a document sheet reading portion 16, and the like, which are accommodated in an apparatus body 11.

The apparatus body 11 includes: a lower body 111, an upper body 112 that is disposed above the lower body 111 so as to oppose the lower body 111; and a connection portion 113 disposed between the upper body 112 and the lower body 111. The connection portion 113 is structured to connect between the lower body 111 and the upper body 112 in a state where the paper sheet discharge portion 15 is disposed between the lower body 111 and the upper body 112. The connection portion 113 is erected from the left portion and the rear portion of the lower body 111, and is L-shaped as viewed in a planar manner. The upper body 112 is supported at an upper end portion of the connection portion 113.

In the lower body 111, the image forming portion 12, the fixing device 13, and the sheet feed portion 14 are mounted. In the upper body 112, the document sheet reading portion 16 and an operation portion 100 (input portion) are mounted. The sheet feed portion 14 includes a sheet feed cassette 142 (sheet cassette) that is detachably mounted to the apparatus body 11. A stack of paper sheets P1 formed by paper sheets P being stacked is stored in the sheet feed cassette 142. In the present embodiment, one sheet feed cassette, that is, the sheet feed cassette 142 is provided. However, two or more sheet feed cassettes may be provided. Further, the lower body 111 includes a power switch 10 that switches the apparatus body 11 between power-on and power-off, and an environmental sensor 60 that detects a temperature and humidity of the inside of the apparatus body 11 (a region near the image forming portion 12).

The image forming portion 12 executes an image forming operation in which a toner image is formed on a paper sheet P fed from the sheet feed portion 14. The image forming portion 12 includes a magenta-color developing unit 12M for magenta toner, a cyan-color developing unit 12C for cyan toner, a yellow-color developing unit 12Y for yellow toner, and a black-color developing unit 12Bk for black toner, which are horizontally disposed sequentially from the upstream side toward the downstream side. Hereinafter, in a case where the developing units need not be distinguished from each other, each developing unit is referred to as a "developing unit 120". Furthermore, the image forming portion 12 includes the intermediate transfer belt 125 (image carrier) that is extended on and between a plurality of rollers such as a driving roller 125A (extending roller) such that the intermediate transfer belt 125 can be moved, in an endless manner, in a secondary scanning direction for image formation. Moreover, the image forming portion 12 includes: a secondary transfer roller 196 that abuts an outer circumferential surface of the intermediate transfer belt 125 in a portion where the intermediate transfer belt 125 is extended by the driving roller 125A; and a belt cleaning device 20.

Each developing unit 120 includes a photosensitive drum 121 (image carrier), a developing device 122 that supplies toner to the photosensitive drum 121, a toner cartridge (not shown) that stores toner, a charging device 123, and a drum cleaning device 127, which are integrally provided. Further, exposure devices 124 that can expose the photosensitive drums 121 are horizontally disposed below the developing units 120 adjacent to each other.

On the circumferential surface of the photosensitive drum 121, an electrostatic latent image and a toner image corresponding to the electrostatic latent image are formed. The developing device 122 supplies toner to the photosensitive drum 121.

The developing device 122 supplies toner to the electrostatic latent image on the circumferential surface of the photosensitive drum 121 that rotates in the direction indicated by an arrow, and allows the toner to be accumulated, thereby forming, on the circumferential surface of the photosensitive drum 121, the toner image based on image data. To each developing device 122, toner is supplied from the toner cartridge as appropriate. As shown in FIG. 2, the developing device 122 includes a developing roller 122A, and a developing bias application portion 122B. The developing roller 122A carries toner, and supplies the toner to the photosensitive drum 121. The developing bias application portion 122B applies a predetermined developing bias to the developing roller 122A, to generate a difference in potential between the developing roller 122A and the photosensitive drum 121. While, in FIG. 2, the magenta-color developing unit 12M is illustrated as an example, other developing units 12 have the same structure.

The charging device 123 is disposed immediately below each photosensitive drum 121. The exposure device 124 is disposed below each charging device 123. The circumferential surface of each photosensitive drum 121 is uniformly charged by the charging device 123. As shown in FIG. 2, each charging device 123 includes a charging roller 123A and a charging bias application portion 123B. The charging roller 123A allows the surface of the photosensitive drum 121 to be charged in a state where the charging roller 123A abuts the photosensitive drum 121. The charging bias application portion 123B applies a predetermined charging bias to the charging roller 123A. While, in FIG. 2, the magenta-color developing unit 12M is illustrated as an example, other developing units 12 have the same structure.

The exposure device 124 applies, to the circumferential surface of the photosensitive drum 121 having been charged, laser light corresponding to each color based on image data inputted from a computer or the like, or image data obtained by the document sheet reading portion 16, to form an electrostatic latent image on the circumferential surface of each photosensitive drum 121. The exposure device 124 applies the laser light to the photosensitive drum 121 with a predetermined exposure in order to generate a predetermined latent image potential. Therefore, even when a set value for exposure indicates an abnormal value, and a great amount of toner is adhered to the photosensitive drum 121, an amount of toner to be discarded, which enters a conveying member 31, can become as small as possible.

The drum cleaning device 127 is disposed to the left of each photosensitive drum 121, and removes residual toner on the circumferential surface of the photosensitive drum 121 to clean the circumferential surface of the photosensitive drum 121. The circumferential surface of the photosensitive drum 121 which is cleaned by the drum cleaning device 127 is rotated toward the charging device 123 for the subsequent charging process.

As shown in FIG. 2, the intermediate transfer belt 125 is an endless belt. The intermediate transfer belt 125 is an electrically conductive soft belt having a layered structure formed by a base layer, an elastic layer, and a coated layer. In the present embodiment, the intermediate transfer belt 125 is positioned on the image forming portion 12 (FIG. 1) and is extended on and between the plurality of extending rollers that are almost horizontally disposed. The extending rollers include the driving roller 125A, a follower roller 125E, a support roller 125D, and a tension roller 125B. The driving roller 125A is disposed near the fixing device 13, and rotation-drives the intermediate transfer belt 125. The follower roller 125E is disposed so as to be spaced from the driving roller 125A by a predetermined distance in the horizontal direction, and rotates so as to follow the driving roller 125A. The support roller 125D is disposed diagonally left-downward of the follower roller 125E. The tension roller 125B is disposed diagonally right-downward of the driving roller 125A, and allows the intermediate transfer belt 125 to be tensioned.

Rotation-driving force is applied to the driving roller 125A, to circulation-drive the intermediate transfer belt 125 clockwise as indicated by arrows in the drawings. In a circulation path of the intermediate transfer belt 125, a horizontal upper surface portion X is formed, by the intermediate transfer belt 125, on the upper surface side of a portion between the driving roller 125A and the follower roller 125E, and the intermediate transfer belt 125 is turned back by the follower roller 125E. Further, in the circulation path of the intermediate transfer belt 125, a horizontal lower surface portion Y is formed, on the intermediate transfer belt 125, in a region between the support roller 125D and the tension roller 125B, and the intermediate transfer belt 125 is turned back by the driving roller 125A.

The photosensitive drums 121Bk, 121Y, 121C, and 121M, as described above, each having a cylindrical shape are disposed below the horizontal lower surface portion Y in a horizontally adjacent manner, so as to correspond to the respective color toners, such that each of the photosensitive drums 121Bk, 121Y, 121C, and 121M opposes the intermediate transfer belt 125. Further, primary transfer rollers 126 that support the intermediate transfer belt 125 from the inner side thereof are disposed at the horizontal lower surface portion Y of the intermediate transfer belt 125, so as to oppose the photosensitive drums 121, respectively.

The secondary transfer roller 196 is disposed outward of the driving roller 125A so as to oppose the driving roller 125A across the intermediate transfer belt 125. A secondary transfer bias application portion 196A is electrically connected to the secondary transfer roller 196. The secondary transfer bias application portion 196A applies a predetermined transfer bias to the secondary transfer roller 196. Due to a transfer bias applied between the secondary transfer roller 196 and the driving roller 125A, a toner image formed on the intermediate transfer belt 125 is transferred to a paper sheet P conveyed by a pair of conveying rollers 192 located therebelow.

Outward of the follower roller 125E, the belt cleaning device 20 is disposed so as to oppose the follower roller 125E across the intermediate transfer belt 125. The belt cleaning device 20 will be described below in detail.

Further, the image forming apparatus 1 includes a sheet detection portion 51 (FIG. 2). The sheet detection portion 51 detects a sheet size of a sheet conveyed in a paper sheet conveying path 190.

The fixing device 13 includes: a heating roller 132 having thereinside an electrically-conductive heat generator, such as a halogen lamp, which acts as a heat source; and a pressurizing roller 134 disposed so as to oppose the heating roller 132. The fixing device 13 causes the heating roller 132 to apply heat to a toner image, on the paper sheet P, having been transferred by the image forming portion 12, to perform fixing process, while the paper sheet P passes through a fixing nip portion formed between the heating roller 132 and the pressurizing roller 134. The paper sheet P on which the fixing process and color printing have been performed is discharged through a sheet discharge conveying path 194 that extends from an upper portion of the fixing device 13, toward a sheet discharge tray 151 disposed at the top portion of the apparatus body 11.

The sheet feed portion 14 includes a manual feed tray 141 that is disposed on a right side wall of the apparatus body 11 as shown in FIG. 1 so as to be openable and closable; and the sheet feed cassette 142 that is detachably mounted below the exposure device 124 in the apparatus body 11.

The paper sheet conveying path 190 is provided to the left of the image forming portion 12 so as to extend in the up-down direction. In the paper sheet conveying path 190, a pair of conveying rollers 192 is disposed at appropriate positions. The pair of conveying rollers 192 conveys the paper sheet P fed by the sheet feed portion 14, toward a secondary transfer nip portion having the secondary transfer roller 196.

The manual feed tray 141 is disposed in the lower portion on the right surface of the lower body 111. The manual feed tray 141 is a tray that allows the paper sheets P to be fed one by one, in a manual operation, toward the image forming portion 12. In the sheet feed cassette 142, a stack of paper sheets P1 formed by a plurality of paper sheets P being stacked is stored. Above the sheet feed cassette 142, a pick-up roller 143 is disposed. The pick-up roller 143 operates to feed an uppermost paper sheet P in the stack of paper sheets P1 stored in the sheet feed cassette 142, toward the paper sheet conveying path 190.

The paper sheet discharge portion 15 is provided between the lower body 111 and the upper body 112. The paper sheet discharge portion 15 includes a sheet discharge tray 151 provided on the top surface of the lower body 111. The sheet discharge tray 151 is a tray onto which the paper sheet P having a toner image formed by the image forming portion 12 and having been subjected to the fixing process by the fixing device 13, is discharged.

The document sheet reading portion 16 includes: a contact glass 161 which is mounted over an opening on the top surface of the upper body 112, and on which a document sheet can be placed: a document sheet pressing cover 162 that is openable and closable and that presses the document sheet placed on the contact glass 161; and a scanning mechanism 163 that scans and reads an image of the document sheet placed on the contact glass 161. The scanning mechanism 163 optically reads an image of the document sheet by using an image sensor such as a CCD (Charge Coupled Device), or a CMOS (Complementary Metal Oxide Semiconductor), to generate image data. Further, the apparatus body 11 includes an image processing portion (not shown) that generates, based on the image data, an image for image formation.

The operation portion 100 is disposed in the upper body 112. The operation portion 100 includes a display portion 101. A user inputs various image forming conditions by using the operation portion 100. For example, sheet size information of sheets stored in the sheet feed cassette 142 is inputted through the operation portion 100. Further, the display portion 101 displays the inputted image forming conditions. Further, on the display portion 101, various warning information is indicated to a user. In another embodiment, the operation portion 100 may be a personal computer that can instruct the image forming apparatus 1 to perform printing operation.

Figure 3:
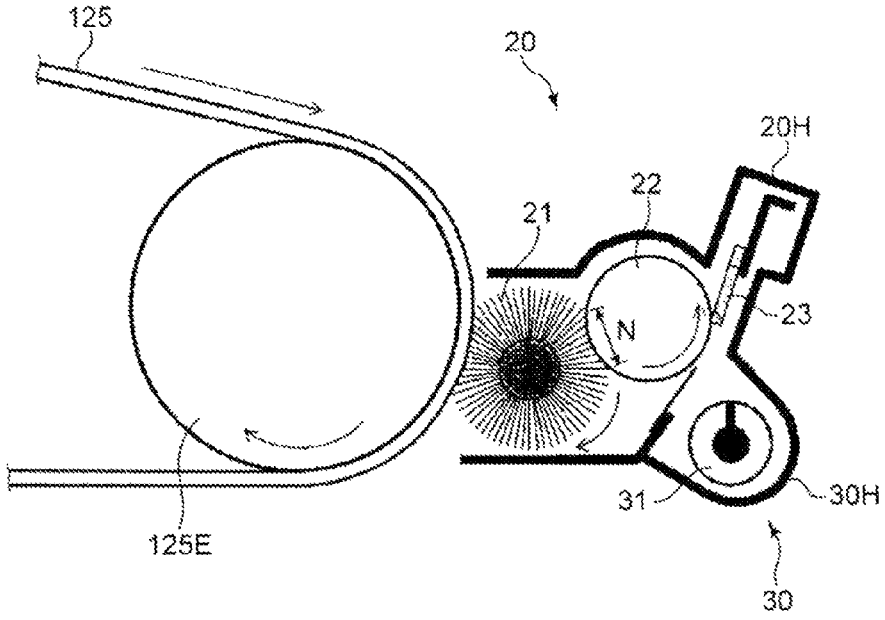
FIG. 3 is an enlarged cross-sectional view illustrating a belt cleaning device located near the intermediate transfer belt of the image forming apparatus according to one embodiment of the present disclosure.
Figure 4:
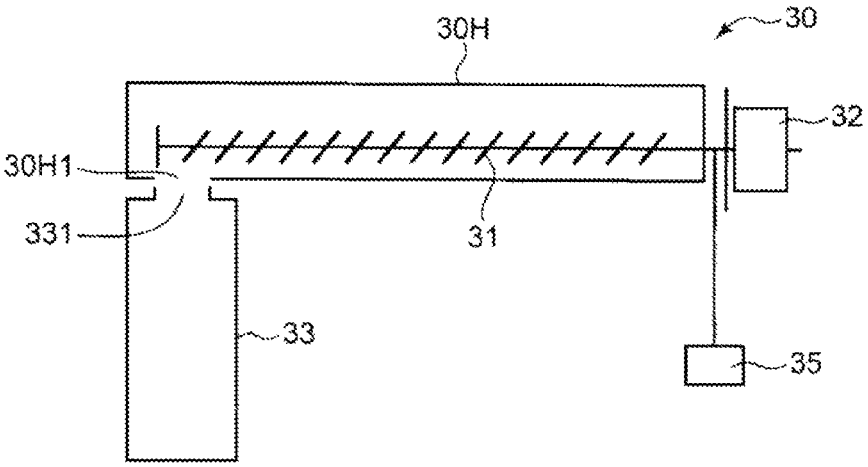
FIG. 4 is a cross-sectional view schematically illustrating a collecting device of the image forming apparatus according to one embodiment of the present disclosure.

Next, the belt cleaning device 20 (cleaning portion) of the present embodiment will be described with reference to FIG. 2 and FIG. 3. The belt cleaning device 20 is disposed outward of the follower roller 125E across the intermediate transfer belt 125. After a secondary transfer has been performed on the paper sheet P by the secondary transfer roller 196, the belt cleaning device 20 removes toner to be discarded (toner to be discarded), which is left on the intermediate transfer belt 125, to perform cleaning for the intermediate transfer belt 125.

The belt cleaning device 20 includes a cleaner housing 20H, a cleaning brush 21, a cleaning roller 22, and a cleaning blade 23. The cleaner housing 20H is a housing member that defines the outer shape of the belt cleaning device 20. The cleaner housing 20H supports the cleaning brush 21, the cleaning roller 22, and the cleaning blade 23.

The cleaning brush 21 contacts with the surface of the intermediate transfer belt 125. The cleaning brush 21 is a brush member that is driven to rotate. By the cleaning brush 21, toner, on the intermediate transfer belt 125, to be discarded is collected.

The cleaning roller 22 contacts with the cleaning brush 21. The cleaning roller 22 is a sponge roller that is driven to rotate. Toner, on the cleaning brush 21, to be discarded is moved to the surface of the cleaning roller 22.

The cleaning blade 23 contacts with the surface of the cleaning roller 22. The cleaning blade 23 is a plate-shaped rubber member. Toner to be discarded, which has been collected on the surface of the cleaning roller 22, is swept by the cleaning blade 23, and is dropped downward.

The image forming apparatus 1 further includes a collecting device 30. The collecting device 30 collects toner to be discarded, which has been collected by the belt cleaning device 20. The collecting device 30 includes a collecting housing 30H, the conveying member 31, a driving motor 32, a collecting container 33, and a torque sensor 35. The collecting housing 30H is a housing member that defines the outer shape of the collecting device 30. The collecting housing 30H is connected to the cleaner housing 20H. The collecting housing 30H supports the conveying member 31 thereinside.

The conveying member 31 is disposed inside the collecting housing 30H. The conveying member 31 is driven to rotate, and conveys toner to be discarded. The conveying member 31 is a screw member that has helical blades around a shaft. As shown in FIG. 3, toner to be discarded, which is swept by the cleaning blade 23, is dropped downward into the collecting housing 30H. The conveying member 31 conveys toner to be discarded from one end, of the collecting housing 30H, connected to the cleaner housing 20H to the other end, of the collecting housing 30H, connected to the collecting container 33.

The driving motor 32 is connected to the conveying member 31, and rotation-drives the conveying member 31.

The collecting container 33 is mounted on the other end side of the collecting housing 30H. Toner, to be discarded, conveyed by the conveying member 31, is dropped from a dropping outlet 30H1 that is open at the other end of the collecting housing 30H, through an inlet 331 that is open at the upper portion of the collecting container 33, into the collecting container 33.

The torque sensor 35 is connected to a shaft portion of the conveying member 31, at a position between the conveying member 31 and the driving motor 32. The torque sensor 35 is a torque measuring portion that detects a rotational torque of the driving motor 32.

Figure 5:
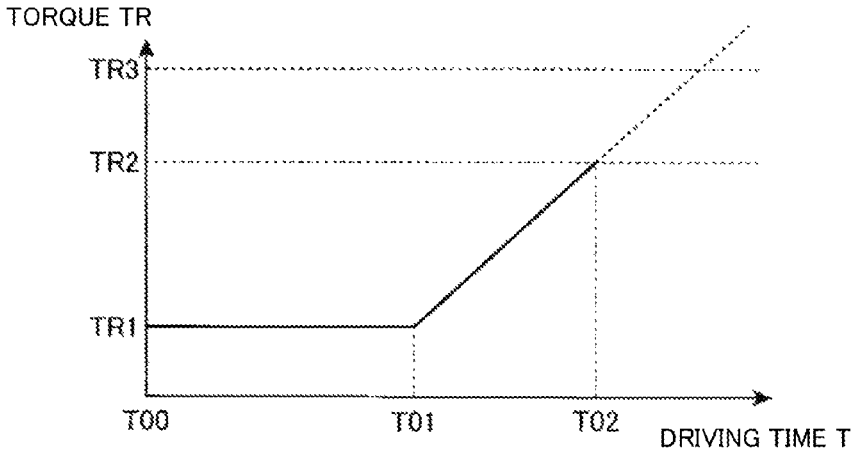
Fig. 5 RELATED ART
FIG. 5 shows a graph representing shift of torque of a conventional conveying member.

Next, problems with the collecting device 30 mounted to the image forming apparatus 1 will be described. FIG. 5 shows a graph representing shift of driving torque (torque TR) of the driving motor 32 in the case of an image forming operation being executed by the image forming apparatus 1. In the graph, a torque TR1 represents a normal torque. When a toner image formed on the intermediate transfer belt 125 (FIG. 2) is transferred to a sheet by the secondary transfer roller 196, a portion of toner (transfer residual toner) is left on the intermediate transfer belt 125. For example, when a transfer efficiency of the secondary transfer roller 196 is 90%, about 10% of toner is left on the intermediate transfer belt 125. When the toner is collected, by the collecting device 30, as toner to be discarded, a driving torque of the driving motor 32 for rotating the conveying member 31 shifts so as to indicate a value close to the torque TR1.

On the other hand, when an abnormal state occurs in the image forming apparatus 1, a great amount of toner that remains attached to the intermediate transfer belt 125 is collected by the belt cleaning device 20, and enters the collecting housing 30H. Table 1 indicates such an exemplary abnormal state.

TABLE 1

| Condition | State | Operation state | Conveyance of toner to be discarded |
|---|---|---|---|
| 1 | Normal | Solid printing with total coverage rate being 250%, and Transfer efficiency of 90% | OK |
| 2 | Normal | Printing of characters with coverage rate for each color being 5%, and Transfer efficiency of 90% | OK |
| 3 | Abnormal | Solid printing with total coverage rate being 250%, and Transfer efficiency of 0% due to secondary transfer current setting error | NG |
| 4 | Abnormal | Printing of characters with coverage rate for each color being 5%, and Transfer efficiency of 0% due to secondary transfer current setting error | NG |
| 5 | Abnormal | Solid printing with total coverage rate being 250%, Transfer efficiency of 90%, and Error in sheet size | NG |
| 6 | Abnormal | Charging bias setting error (bias of zero) in charging roller | NG |
| 7 | Abnormal | Exposure setting error in exposure device | NG |

*A4 in landscape orientation, 500 sheets Continuous printing

In Table 1, in condition 1, toner images of four colors are formed on the intermediate transfer belt 125 with the total coverage rate being about 250%, and the toner image is transferred to an A4 size sheet in the landscape orientation with the secondary transfer efficiency being 90%. In condition 2, character images are formed on the intermediate transfer belt 125 with the coverage rate for each color being about 5%, and the toner image is transferred to a sheet with the secondary transfer efficiency being 90%. In each of conditions 1 and 2, a driving torque of the driving motor 32 shifts so as to indicate a value close to the torque TR1 described above.

On the other hand, in condition 3, due to an error occurring under the same condition as condition 1, no transfer bias is applied to the secondary transfer roller 196, and the transfer efficiency is 0%. In this case, toner by which a toner image may be formed with the coverage rate being 250% enters the collecting housing 30H. Similarly, in condition 4, due to an error occurring under the same condition as condition 2, no transfer bias is applied to the secondary transfer roller 196, and the transfer efficiency is 0%. Further, in condition 5, a sheet size to be used is incorrect under the same condition as condition 1. Namely, in the same condition as condition 1, a toner image that has been formed on the intermediate transfer belt 125 so as to correspond to an A4 size sheet in the landscape orientation, is transferred to an A4 size sheet in the portrait orientation. In this case, since toner outside a region of a lateral width of an A4 size sheet in the portrait orientation is not transferred to a sheet, the toner enters the collecting housing 30H. Further, in condition 6, an error occurs in charging bias applied to the charging roller 123A. In this case, since no charging potential (dark potential) is generated on the photosensitive drum 121, a great amount of toner is moved onto the photosensitive drum 121 due to developing bias applied to the developing roller 122A. The toner is moved from the photosensitive drum 121 to the intermediate transfer belt 125, and then enters the collecting housing 30H. In condition 7, laser light from the exposure device 124 is abnormal. In this case, an amount of laser light (exposure) which is preset is abnormal, and a great amount of toner is moved from the developing roller 122A to the photosensitive drum 121 as in condition 6. The toner also enters the collecting housing 30H.

Thus, sudden occurrence of an abnormal state in the image forming apparatus 1 results in an amount of toner that enters the collecting housing 30H becoming greater than an amount of toner that is normally conveyed. In FIG. 5, in a case where such an abnormal state occurs at time T01, load on the conveying member 31 is increased, thereby increasing a rotational torque of the driving motor 32. When the rotational torque reaches a torque TR3, the driving motor 32 may be out of order and/or the conveying member 31 may be damaged. Therefore, in conventional arts, when a driving torque of the driving motor 32 reaches a torque TR2 which is preset, an image forming operation of the image forming apparatus 1 is interrupted, and a restoration operation is performed by a service person. However, in this case, the image forming apparatus 1 cannot be used for a certain time period, and it is inconvenient for users.

Figure 6:
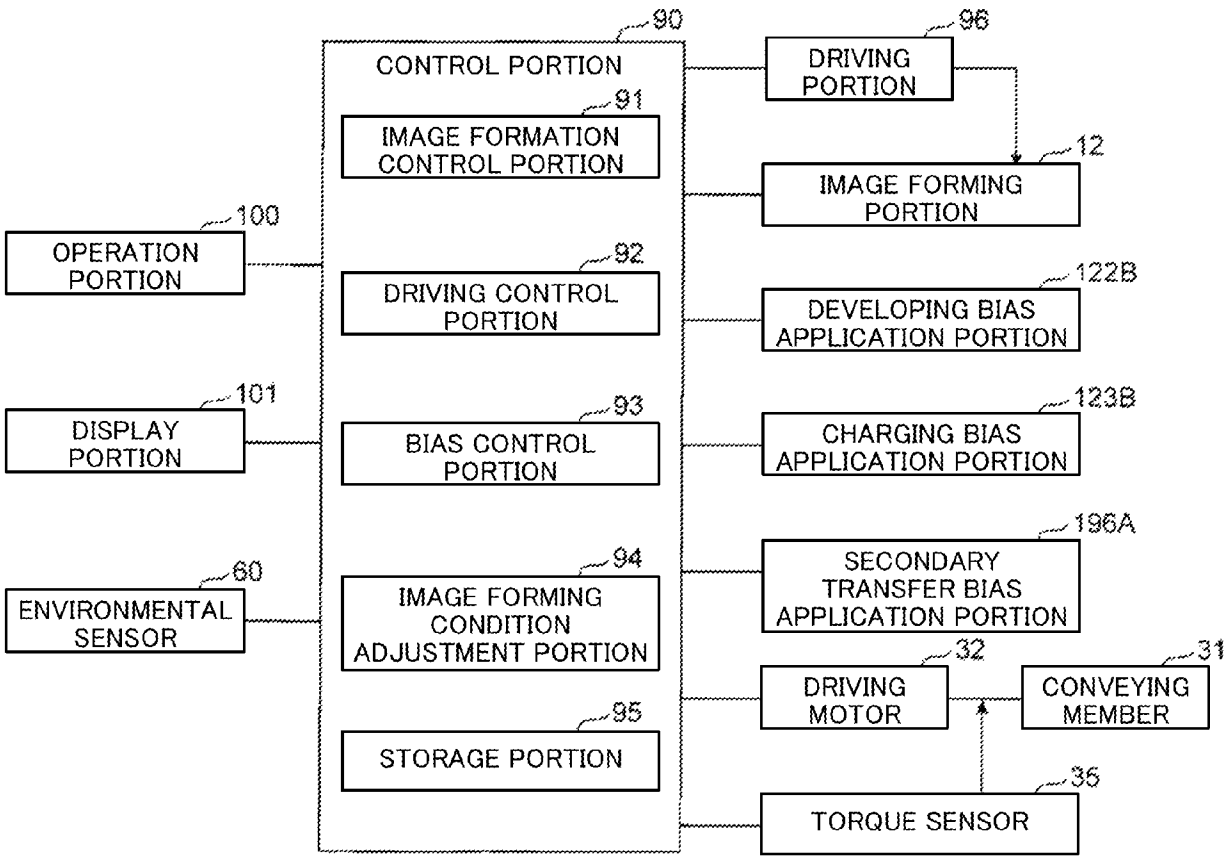
FIG. 6 is a block diagram illustrating an electrical configuration associated with an image forming condition adjustment operation according to one embodiment of the present disclosure.

In the present embodiment, in order to solve the aforementioned problems, even in a case where an abnormal state occurs in the image forming apparatus 1, an image forming condition adjustment portion 94 enables the image forming operation to be as continuous as possible. Hereinafter, an image forming condition adjustment operation according to the present embodiment will be described. FIG. 6 is a block diagram illustrating an electrical configuration of a control portion 90. The control portion 90 comprehensively controls the image forming apparatus 1, and is electrically connected to and transmits control signals to the operation portion 100, the sheet detection portion 51, the environmental sensor 60, the image forming portion 12, the developing bias application portion 122B, the charging bias application portion 123B, the secondary transfer bias application portion 196A, the driving motor 32, the torque sensor 35, the display portion 101, and the like, which are mounted in the apparatus body as described above. Further, the control portion 90 is electrically connected to a driving portion 96. The driving portion 96 is a driving unit that rotation-drives components of the image forming portion 12 when an image forming operation is executed by the image forming portion 12.

The control portion 90 includes: a CPU (Central Processing Unit); a ROM (Read Only Memory) in which a control program is stored; a RAM (Random Access Memory) that is used as a work area for the CPU; and the like. The control portion 90 executes the control program by means of the CPU, to cause an image formation control portion 91, a driving control portion 92, a bias control portion 93, the image forming condition adjustment portion 94, and a storage portion 95 to function.

The image formation control portion 91 comprehensively controls devices of the image forming apparatus 1 when an image forming operation is executed by the image forming apparatus 1. Further, the image formation control portion 91 controls temporary stopping, halting, and restarting of the image forming operation.

The driving control portion 92 causes the driving portion 96 to rotation-drive each component of the image forming apparatus 1 when the image forming operation is executed.

The bias control portion 93 controls, when the image forming operation is executed, the developing bias application portion 122B, the charging bias application portion 123B, and the secondary transfer bias application portion 196A, to apply a developing bias, a charging bias, and a transfer bias to the developing roller 122A, the charging roller 123A, and the secondary transfer roller 196, respectively.

The image forming condition adjustment portion 94 checks and corrects image forming conditions for the image forming apparatus 1. The image forming condition adjustment portion 94 checks and corrects a developing bias applied to the developing roller 122A, a charging bias applied to the charging roller 123A, and a transfer bias applied to the secondary transfer roller 196. Further, the image forming condition adjustment portion 94 checks and corrects a sheet size of a sheet on which a toner image is formed.

The storage portion 95 stores various control parameters. The storage portion 95 stores threshold values TR(A), TR(B), and TR(C) that are preset for the driving torque TR of the driving motor 32. The image formation control portion 91 compares the driving torque TR detected by the torque sensor 35, with the threshold values TR(A), TR(B), and TR(C).

Further, the storage portion 95 stores sheet input information Pdata. The sheet input information Pdata is information inputted through the operation portion 100 by a user, and represents a sheet size and a basis weight for sheets stacked in the sheet feed cassette 142. Further, the storage portion 95 stores image size information Idata. The image size information Idata is image size information that is inputted through the operation portion 100 by a user based on a size of a toner image as desired by the user.

Further, the storage portion 95 stores a set value Vdc(C) of a developing bias. The set value Vdc(C) is used by the image formation control portion 91 when the developing bias application portion 122B is controlled. Furthermore, the storage portion 95 previously stores a developing bias table Td. The developing bias table Td indicates target values Vdc(M), of a plurality of developing biases, which are appropriately preset so as to correspond to environmental information Edata detected by the environmental sensor 60.

Moreover, the storage portion 95 stores a set value Vtr(C) of a transfer bias. The set value Vtr(C) is used by the image formation control portion 91 when the secondary transfer bias application portion 196A is controlled. Furthermore, the storage portion 95 previously stores a transfer bias table Tt. The transfer bias table Tt indicates target values Vtr(M), of a plurality of transfer biases, which are appropriately preset so as to correspond to the environmental information Edata detected by the environmental sensor 60 and the sheet input information Pdata.

Figure 7:
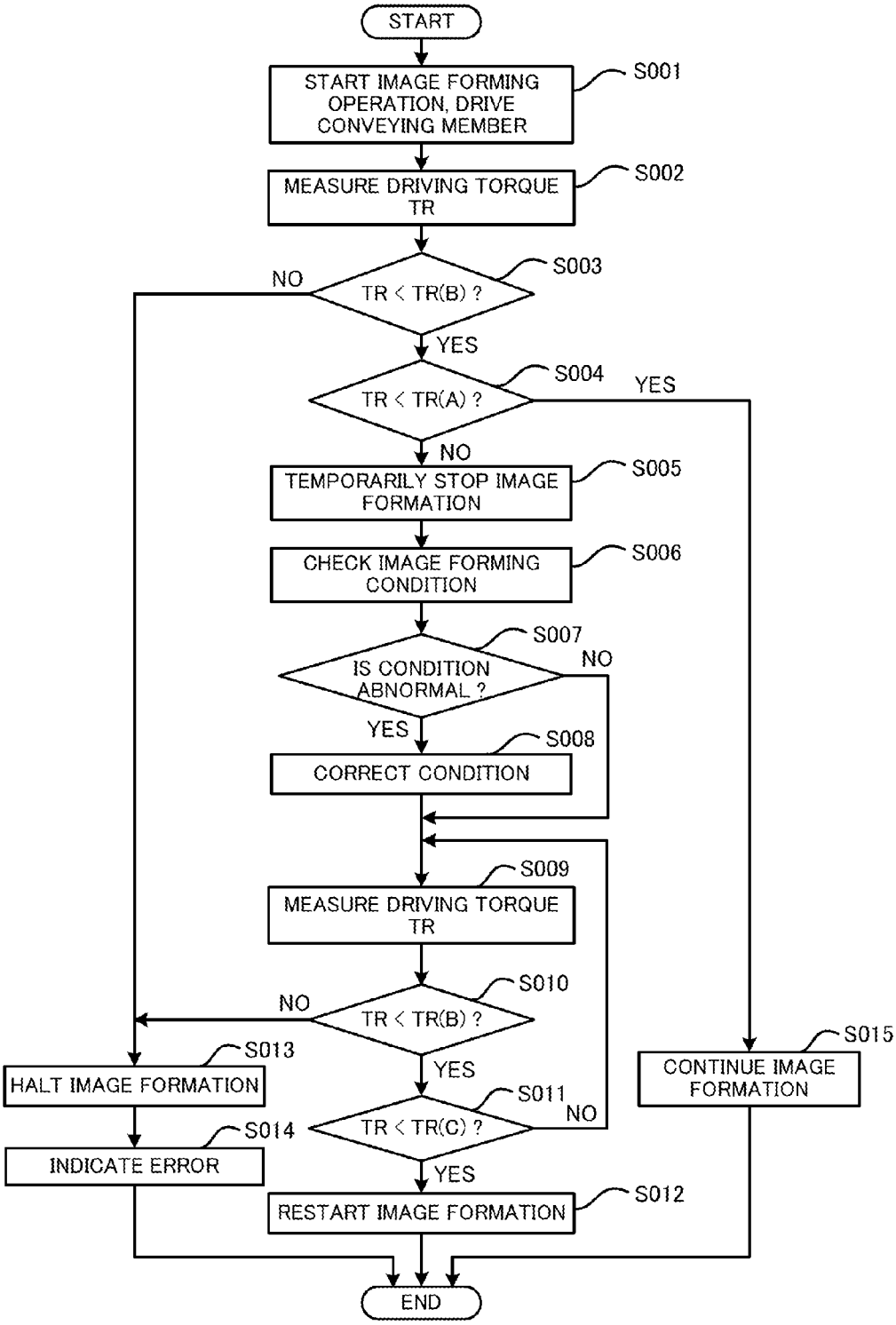
FIG. 7 is a flow chart showing an image forming condition adjustment operation according to a first embodiment of the present disclosure.

Next, an image forming operation according to the first embodiment of the present disclosure will be described in detail. FIG. 7 is a flow chart showing an image forming operation according to the present embodiment. In the present embodiment, not only a state in which an amount of toner is abnormal at a time when the secondary transfer of a toner image to a sheet is performed, but also a state where an abnormal amount of toner is discharged from the developing roller 122A in the course of a toner image being formed on the photosensitive drum 121, are described.

When a printing operation is started by the image forming apparatus 1, an operation of each component of the image forming apparatus 1 is started by the image formation control portion 91 (step S001). At this time, the image formation control portion 91 causes the driving motor 32 to drive the conveying member 31. Toner to be discarded, which is left in the collecting housing 30H by the previous image forming operation, is conveyed toward the collecting container 33 by the conveying member 31.

The image formation control portion 91 causes the torque sensor 35 to detect the driving torque TR of the driving motor 32 (step S002). The image formation control portion 91 compares the driving torque TR detected by the torque sensor 35 with the threshold value TR(B) that is previously stored in the storage portion 95 (step S003). In a case where the driving torque TR having been detected is greater than or equal to the threshold value TR(B) (NO in step S003), the image formation control portion 91 determines that the driving torque of the driving motor 32 indicates such a high value as to make restoration difficult, and halts the image forming operation (printing operation) (step S013). Further, the image formation control portion 91 causes the display portion 101 to display information indicating that the image forming operation is halted, and information indicating that the torque of the driving motor 32 indicates an abnormal value (step S014).

On the other hand, in a case where the driving torque TR having been detected is less than the threshold value TR(B) (YES in step S003), the image formation control portion 91 further compares the driving torque TR with the threshold value TR(A) (step S004). In a case where the driving torque TR having been detected is less than the threshold value TR(A) (YES in step S004), the image formation control portion 91 determines that there is no problem with the driving torque of the driving motor 32, and that the image forming condition of the image forming apparatus 1 is not abnormal, and continues the image forming operation (printing operation) (step S015).

On the other hand, in a case where the driving torque TR having been detected is greater than or equal to the threshold value TR(A) (NO in step S004), the image formation control portion 91 determines that the driving torque TR of the driving motor 32 is high, and the image forming condition needs to be checked. Therefore, the image formation control portion 91 temporarily stops the image forming operation while driving of the conveying member 31 by the driving motor 32 is continuously performed (step S005). Thus, toner to be discarded is prevented from additionally entering the conveying member 31. "Temporarily stop the image forming operation" means that, although a toner image being formed on the photosensitive drum 121 at that time is transferred to a sheet, and the sheet is discharged, no image forming operation is performed on the subsequent sheets. According to the image forming operation being temporarily stopped, the image formation control portion 91 causes the image forming condition adjustment portion 94 to check and correct the image forming condition (step S006).

The image forming condition adjustment portion 94 checks the image forming condition such as a developing bias as described below (step S007). In a case where the image forming condition is abnormal (YES in step S007), the image forming condition adjustment portion 94 executes correction of the condition (step S008). When the correction of the image forming condition has been executed by the image forming condition adjustment portion 94, the image formation control portion 91 causes the torque sensor 35 to detect again the driving torque TR of the driving motor 32 (step S009). Also when it is determined in step S007 that the image forming condition is not abnormal (NO in step S007), the image formation control portion 91 causes the torque sensor 35 to detect again the driving torque TR of the driving motor 32.

As described above, the conveying member 31 continues to be driven by the driving motor 32. Thus, by the image forming condition being corrected, an amount of toner to be discarded, which enters the collecting housing 30H, is reduced. Therefore, reduction of the driving torque TR of the driving motor 32 is expected. However, in a case where a great amount of toner to be discarded, which enters the collecting housing 30H, is not due to the image forming condition, the driving torque TR may continue to increase. Therefore, the image formation control portion 91 compares again the driving torque TR having been detected in step S009 with the threshold value TR(B) (step S010). In a case where the driving torque TR having been detected again is greater than or equal to the threshold value TR(B) (NO in step S010), the image formation control portion 91 determines that increase of the driving torque TR of the driving motor 32 may not be stopped by correction of the image forming condition, and halts the image forming operation (printing operation) as described above (step S013). Similarly, the image formation control portion 91 causes the display portion 101 to display information indicating that the image forming operation is halted, and information indicating that the torque of the driving motor 32 indicates an abnormal value (step S014).

On the other hand, in a case where the driving torque TR having been detected again is less than the threshold value TR(B) (YES in step S010), the image formation control portion 91 further compares the driving torque TR with the threshold value TR(C) (step S011). The threshold value TR(C) is a preset threshold value which is less than the threshold value TR(A), and by which whether or not the driving torque TR has been restored can be determined. In a case where the driving torque TR having been detected again is greater than or equal to the threshold value TR(C) (NO in step S011), the image formation control portion 91 determines that the driving of the conveying member 31 is insufficient, and continuous driving of the conveying member 31, and comparison and determination process steps, for the driving torque TR, from step S009 to step S011, are repeated. On the other hand, in a case where the driving torque TR having been detected again is less than the threshold value TR(C) (YES in step S011), the image formation control portion 91 determines that the driving torque TR has been restored according to the correction of the image forming condition, to restart the image forming operation (step S012). In a case where, although the process steps of step S009 to step S011 are repeated plural times, the driving torque TR is not reduced so as to be less than the threshold value TR(C), the image formation control portion 91 may determine that timeout occurs, and advance the process to step S013, to halt the image forming operation.

As described above, in the present embodiment, in a case where the driving torque TR is greater than or equal to the threshold value TR(B), the printing operation is halted in order to prevent the collecting device 30 from being out of order. Therefore, damages of the conveying member 31 and the driving motor 32 are advantageously prevented. Further, in a case where the driving torque is greater than or equal to the threshold value TR(A), and less than the threshold value TR(B), adjustment of the image forming condition is executed. Therefore, in a case where the image forming condition is abnormal, and a great amount of toner to be discarded temporarily enters the collecting housing 30H, the abnormal condition can be canceled to restore the image forming condition, and the driving torque TR of the driving motor 32 can be reduced. Therefore, halting of the image forming operation and restoring work by a service person for each abnormal state are unnecessary, thereby stably performing the image forming operation as continuously as possible.

Figure 8:
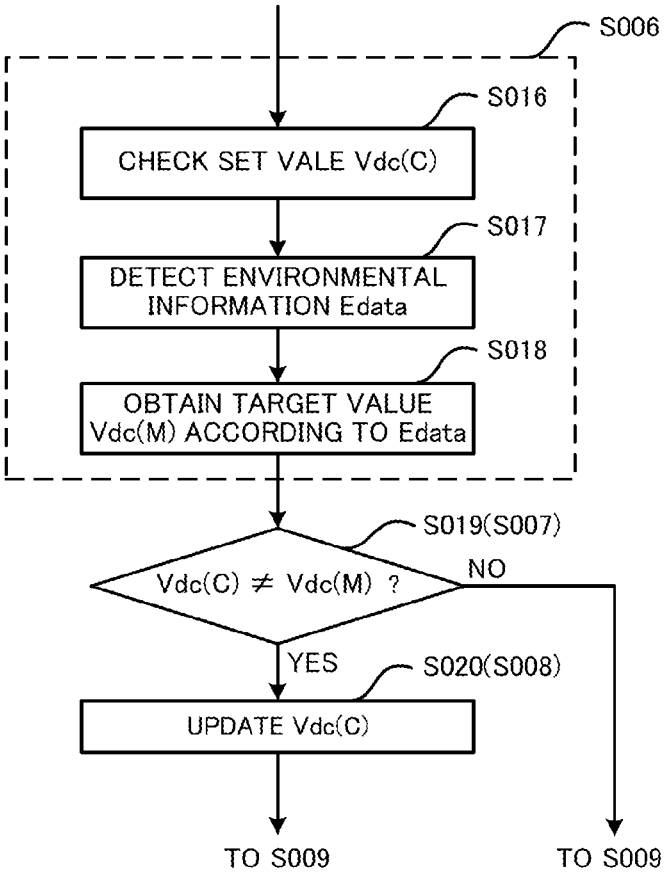
FIG. 8 is a flow chart partially showing the image forming condition adjustment operation according to the first embodiment of the present disclosure.

Next, the adjustment of the image forming condition as performed in steps S006 and S007 shown in FIG. 7 will be further described in detail with reference to FIG. 8. FIG. 8 is a flow chart partially showing an operation of adjusting, as the image forming condition, a set value of a developing bias applied to the developing roller 122A.

As a process step for step S006 in FIG. 7, the image forming condition adjustment portion 94 executes a process step of checking the set value Vdc(C) of the developing bias stored in the storage portion 95 (step S016). The set value Vdc(C) is the most recent set value that is actually referenced when the developing bias application portion 122B is controlled. Next, the image forming condition adjustment portion 94 causes the environmental sensor 60 to detect the most recent environmental information Edata (step S017). The environmental information Edata represents a temperature or a humidity near the image forming portion 12. Further, the image forming condition adjustment portion 94 obtains, with reference to the developing bias table Td that is previously stored in the storage portion 95, the target value Vdc(M) (set condition) of an appropriate developing bias corresponding to the environmental information Edata having been detected (step S018).

As a process step for step S007 in FIG. 7, the image forming condition adjustment portion 94 executes a process step of comparing the set value Vdc(C) of the developing bias being currently used, with the target value Vdc(M) having been obtained (step S019). In a case where the set value Vdc(C) is equal to the target value Vdc(M) (NO in step S019), the image forming condition adjustment portion 94 advances the process to step S009 in FIG. 7 without correcting (updating) the set value Vdc(C).

On the other hand, in a case where the set value Vdc(C) is not equal to the target value Vdc(M) (YES in step S019), the image forming condition adjustment portion 94 updates the set value Vdc(C) with the target value Vdc(M) having been obtained (step S020, corresponding to step S008 in FIG. 7). Thereafter, the image forming condition adjustment portion 94 advances the process to step S009 in FIG. 7. When, in step S019, the set value Vdc(C) of the developing bias is compared with the target value Vdc(M) having been obtained, approximation within a predetermined range may be determined for comparison, without determining strict equality of the values.

As described above, in the present embodiment, in a case where an incorrect value is used as the set value Vdc(C) of the developing bias due to some error, and a great amount of toner moves from the developing roller 122A to the photosensitive drum 121, the set value Vdc(C) is updated to stop the movement of the toner. Therefore, an amount of toner to be discarded, which enters the collecting housing 30H through the intermediate transfer belt 125, is reduced, and the driving torque TR of the driving motor 32 is advantageously restored as described above, and the image forming operation can be performed as continuously as possible.

Figure 9:
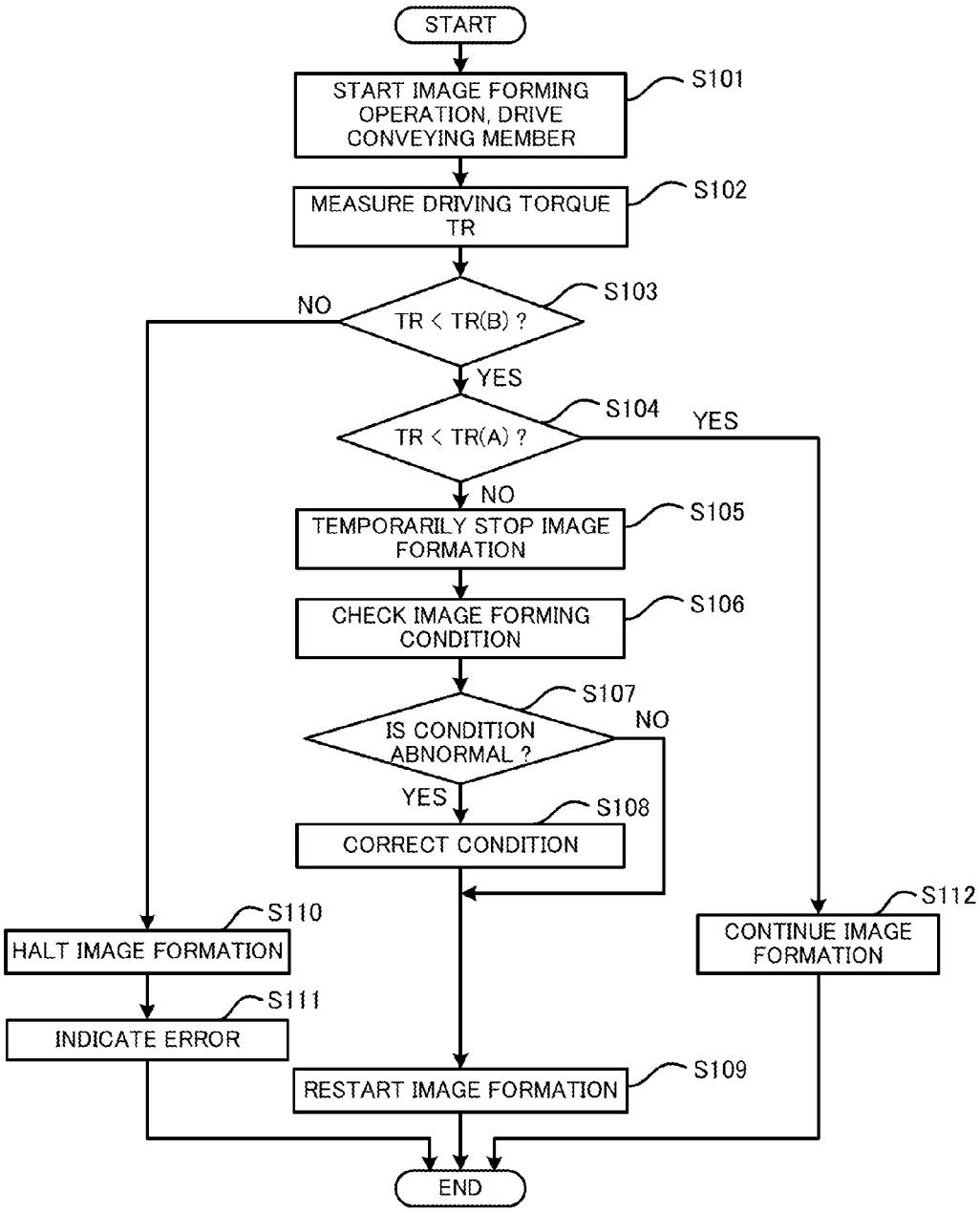
FIG. 9 is a flow chart showing an image forming condition adjustment operation according to a second embodiment of the present disclosure.

Next, an image forming operation according to a second embodiment of the present disclosure will be described in detail. FIG. 9 is a flow chart showing an image forming operation according to the present embodiment. In the present embodiment, a case is assumed where, at a time when the secondary transfer of a toner image to a sheet is performed, an abnormal amount of toner is left on the intermediate transfer belt 125.

As in the embodiment described above, when a printing operation is started by the image forming apparatus 1, an operation of each component of the image forming apparatus 1 is started by the image formation control portion 91 (step S101). At this time, the image formation control portion 91 causes the driving motor 32 to drive the conveying member 31. Toner to be discarded, which is left in the collecting housing 30H by the previous image forming operation, is conveyed toward the collecting container 33 by the conveying member 31.

The image formation control portion 91 causes the torque sensor 35 to detect the driving torque TR of the driving motor 32 (step S102). The image formation control portion 91 compares the driving torque TR detected by the torque sensor 35 with the threshold value TR(B) that is previously stored in the storage portion 95 (step S103). In a case where the driving torque TR having been detected is greater than or equal to the threshold value TR(B) (NO in step S103), the image formation control portion 91 determines that the driving torque of the driving motor 32 indicates such a high value as to make restoration difficult, and halts the image forming operation (printing operation) (step S110). Further, the image formation control portion 91 causes the display portion 101 to display information indicating that the image forming operation is halted, and information indicating that the torque of the driving motor 32 indicates an abnormal value (step S111).

On the other hand, in a case where the driving torque TR having been detected is less than the threshold value TR(B) (YES in step S103), the image formation control portion 91 further compares the driving torque TR with the threshold value TR(A) (step S104). In a case where the driving torque TR having been detected is less than the threshold value TR(A) (YES in step S104), the image formation control portion 91 determines that there is no problem with the driving torque of the driving motor 32, and that the image forming condition of the image forming apparatus 1 is not abnormal, and continues the image forming operation (printing operation) (step S112).

On the other hand, in a case where the driving torque TR having been detected is greater than or equal to the threshold value TR(A) (NO in step S104), the image formation control portion 91 determines that the driving torque TR of the driving motor 32 is high, and the image forming condition needs to be checked. Therefore, the image formation control portion 91 temporarily stops the image forming operation while driving of the conveying member 31 by the driving motor 32 is continuously performed (step S105). According to the image forming operation being temporarily stopped, the image formation control portion 91 causes the image forming condition adjustment portion 94 to check and correct the image forming condition (step S106).

The image forming condition adjustment portion 94 checks the image forming condition such as a secondary transfer bias as described below (step S107). In a case where the image forming condition is abnormal (YES in step S107), the image forming condition adjustment portion 94 executes correction of the condition (step S108). When the correction of the image forming condition has been executed by the image forming condition adjustment portion 94, the image forming operation is restarted (step S109). Also when it is determined in step S107 that the image forming condition is not abnormal (NO in step S107), the image formation control portion 91 restarts the image forming operation. After the image forming operation is restarted and the flow of a series of the process steps ends, the image formation control portion 91 repeatedly performs the flow of the process steps starting from step S101. In a case where, as a result, the driving torque TR is not restored even in the case of the image forming condition having been corrected (NO in step S103 or NO in step S104), the image forming operation is halted or temporarily stopped. Thus, in a case where a great amount of toner to be discarded is generated due to a cause other than an abnormal image forming condition, the generation of the toner to be discarded can be stopped. In a case where, although the correction (step S108) of the image forming condition is repeatedly performed for a predetermined number of times, the driving torque TR is not restored, the image forming apparatus 1 may halt the image forming operation.

As described above, also in the present embodiment, in a case where the driving torque TR is greater than or equal to the threshold value TR(B), the printing operation is halted in order to prevent the collecting device 30 from being out of order. Further, in a case where the driving torque is greater than or equal to the threshold value TR(A), and less than the threshold value TR(B), adjustment of the image forming condition is executed. Therefore, in a case where the image forming condition is abnormal, and a great amount of toner to be discarded temporarily enters the collecting housing 30H, the abnormal condition can be canceled to restore the image forming condition, and the driving torque TR of the driving motor 32 can be reduced. Therefore, halting of the image forming operation and restoring work by a service person for each abnormal state are unnecessary, thereby performing the image forming operation as continuously as possible.

Figure 10:
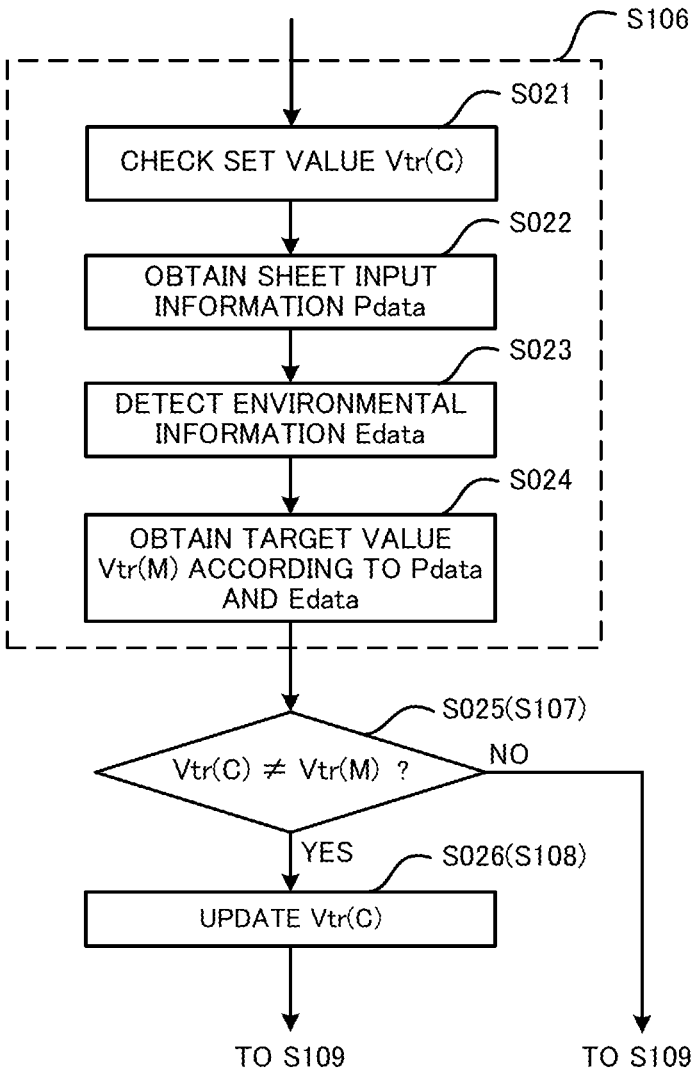
FIG. 10 is a flow chart partially showing the image forming condition adjustment operation according to the second embodiment of the present disclosure.

Next, the adjustment of the image forming condition as performed in steps S106 and S107 shown in FIG. 9 will be further described in detail with reference to FIG. 10. FIG. 10 is a flow chart partially showing an operation of adjusting, as the image forming condition, a set value of a transfer bias (secondary transfer bias) applied to the secondary transfer roller 196. The present embodiment represents an adjustment operation for abnormal states in conditions 3 and 4 indicated above in Table 1.

As a process step for step S106 in FIG. 9, the image forming condition adjustment portion 94 executes a process step of checking the set value Vtr(C) of the transfer bias stored in the storage portion 95 (step S021). The set value Vtr(C) is the most recent set value that is actually referenced when the secondary transfer bias application portion 196A is controlled. Next, the image forming condition adjustment portion 94 obtains the sheet input information Pdata stored in the storage portion 95 (step S022). The sheet input information Pdata is information that is inputted by a user through the operation portion 100, that is stored in the storage portion 95, and that represents a sheet size and a basis weight for sheets stacked in the sheet feed cassette 142. Further, the image forming condition adjustment portion 94 causes the environmental sensor 60 to detect the most recent environmental information Edata (step S023). Further, the image forming condition adjustment portion 94 obtains, with reference to the transfer bias table Tt that is previously stored in the storage portion 95, the target value Vtr(M) (set condition) of an appropriate transfer bias which corresponds to the obtained sheet input information Pdata and environmental information Edata (step S024).

As a process step for step S107 in FIG. 9, the image forming condition adjustment portion 94 executes a process step of comparing the set value Vtr(C) of the transfer bias being currently used, with the target value Vtr(M) having been obtained (step S025). In a case where the set value Vtr(C) is equal to the target value Vtr(M) (NO in step S025), the image forming condition adjustment portion 94 advances the process to step S109 in FIG. 9 without correcting (updating) the set value Vtr(C).

On the other hand, in a case where the set value Vtr(C) is not equal to the target value Vtr(M) (YES in step S025), the image forming condition adjustment portion 94 updates the set value Vtr(C) with the target value Vtr(M) having been obtained. Thereafter, the image forming condition adjustment portion 94 advances the process to step S109 in FIG. 9. As in the embodiment described above, when, in step S025, the set value Vtr(C) of the transfer bias is compared with the target value Vtr(M) having been obtained, approximation within a predetermined range may be determined for comparison, without determining strict equality of the values.

As described above, in the image forming apparatus 1, an incorrect value may be used as the set value Vtr(C) of the transfer bias applied to the secondary transfer roller 196 due to some error. As a result, due to an abnormal (low) transfer efficiency, transfer of a toner image from the intermediate transfer belt 125 to a sheet is insufficient, and a great amount of toner is left on the intermediate transfer belt 125. Also in such a case, in the embodiment described above, the set value Vtr(C) is updated, to cancel the abnormal state of the transfer efficiency. Therefore, an amount of toner to be discarded, which enters the collecting housing 30H through the intermediate transfer belt 125, is reduced. Therefore, when, in step S109 in FIG. 9, the image forming operation is restarted, the driving torque TR of the driving motor 32 is advantageously restored. Also in the present embodiment, after step S108 in FIG. 9, the driving torque TR may be measured again as in steps S009 to S011 in FIG. 7.

Figure 11:
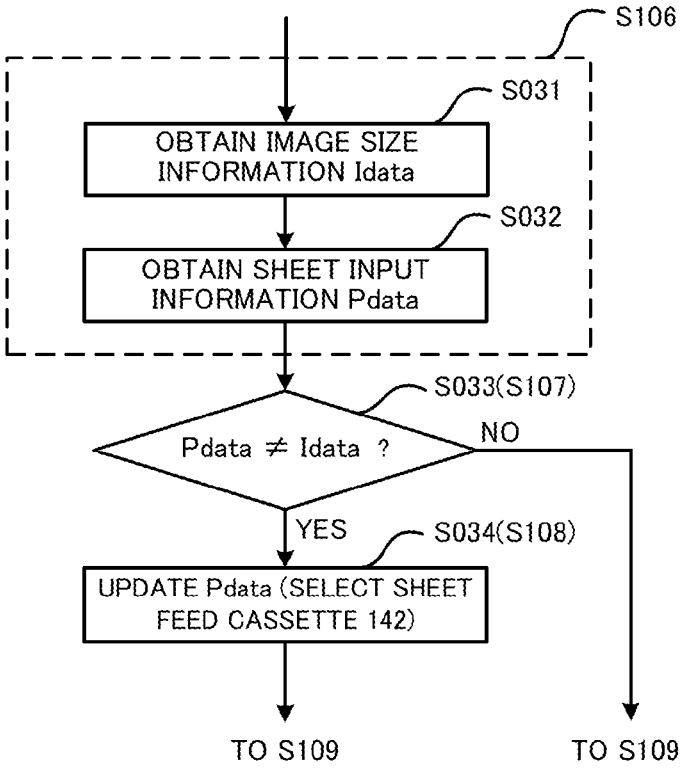
FIG. 11 is a flow chart partially showing the image forming condition adjustment operation according to the second embodiment of the present disclosure.

Next, the adjustment of the image forming condition, according to another embodiment, as performed in steps S106 and S107 shown in FIG. 9 will be further described in detail with reference to FIG. 11. FIG. 11 is a flow chart partially showing an operation of adjusting, as the image forming condition, a set value of a sheet size. The present embodiment represents an adjustment operation for an abnormal state in condition 5 in Table 1 indicated above. In the present embodiment, the image forming apparatus 1 includes, as the sheet feed cassette 142, a plurality of sheet feed cassettes, that is, sheet feed cassettes 142A and 142B, which is not shown in FIG. 1. In the sheet feed cassette 142A, A4 size sheets in the portrait orientation are stored. On the other hand, in the sheet feed cassette 142B, A4 size sheets in the landscape orientation are stored. Further, the sheet input information Pdata for the sheets stored in the sheet feed cassettes 142A and 142B is previously inputted through the operation portion 100 by a user, and is stored in the storage portion 95. The sheet input information Pdata represents a sheet size and a basis weight for sheets stacked in the sheet feed cassette 142. Further, it is assumed that, for executing the image forming operation, the sheet feed cassette 142A is previously selected as the sheet feed cassette 142 to be used.

As a process step for step S106 in FIG. 9, the image forming condition adjustment portion 94 performs a process step of obtaining the image size information Idata that is inputted through the operation portion 100 and stored in the storage portion 95 (step S031). The image size information Idata is image size information that is inputted through the operation portion 100 by a user based on a size of a toner image as desired by the user. In other words, in a case where the operation portion 100 is a personal computer connected to the image forming apparatus 1, the image size information Idata represents a sheet size of an image, to be printed, which is previously inputted (set) in the personal computer by the user. Further, the image forming condition adjustment portion 94 obtains the sheet input information Pdata (A) that corresponds to the sheet feed cassette 142A and is stored in the storage portion 95 (step S032).

As a process step for step S107 in FIG. 9, the image forming condition adjustment portion 94 performs a process step of comparing the image size information Idata having been obtained, with the sheet input information Pdata (A) (step S033). In a case where the sheet input information Pdata (A) and the image size information Idata having been preset match (NO in step S033), the image forming condition adjustment portion 94 advances the process to step S109 in FIG. 9 without performing correction (update) for the sheet feed cassette 142A to be selected.

On the other hand, when the sheet input information Pdata (A) and the image size information Idata having been preset do not match (YES in step S033), the image forming condition adjustment portion 94 selects the sheet feed cassette 142B represented by the sheet input information Pdata (B) other than the sheet input information Pdata (A), to update the sheet input information Pdata (step S034, corresponding to step S108 in FIG. 9).

As described above, in the image forming apparatus 1, an incorrect sheet feed cassette may be selected, due to some error, as the sheet feed cassette 142 in which sheets corresponding to the image size information Idata are stored. As a result, a great amount of toner is left on the intermediate transfer belt 125 since the size of the toner image and the sheet size do not match. Even in such a case, in the embodiment described above, by the sheet feed cassette 142 to be selected being corrected, a state where the toner is left is avoided. Therefore, an amount of toner to be discarded, which enters the collecting housing 30H through the intermediate transfer belt 125, is reduced. Consequently, when, in step S109 in FIG. 9, the image forming operation is restarted, the driving torque TR of the driving motor 32 is advantageously restored.

Figure 12:
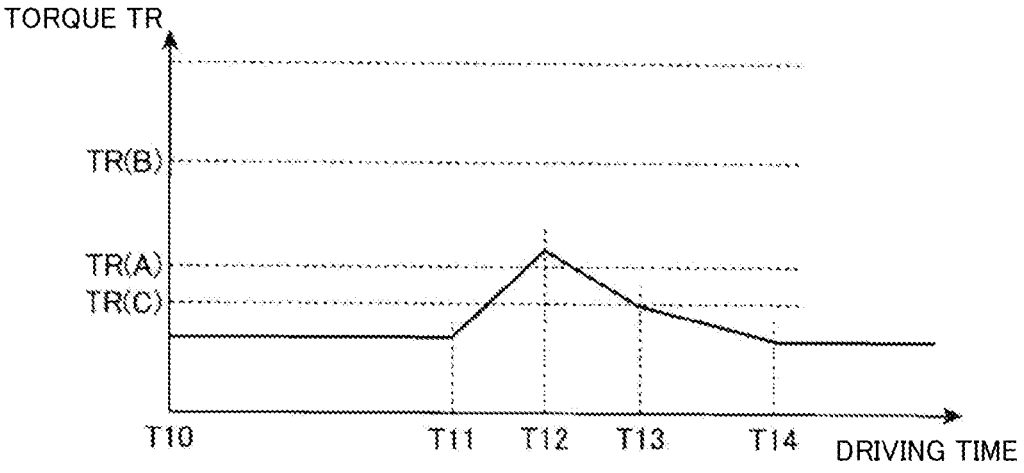
FIG. 12 shows a graph representing shift of torque of a conveying member in the case of the image forming condition adjustment operation according to an embodiment of the present disclosure being performed.
Figure 13:
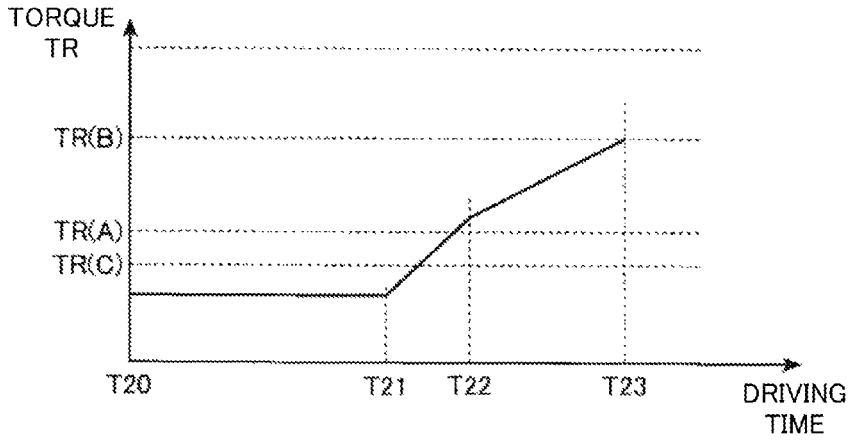
FIG. 13 shows a graph representing shift of torque of the conveying member in the case of the image forming condition adjustment operation according to an embodiment of the present disclosure being performed.
Figure 14:
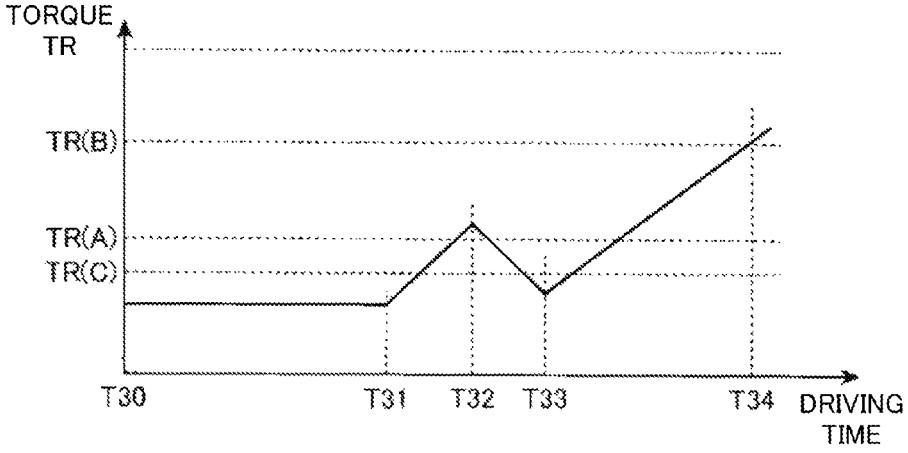
FIG. 14 shows a graph representing shift of torque of the conveying member in the case of the image forming condition adjustment operation according to an embodiment of the present disclosure being performed.

Next, shift of the driving torque TR of the driving motor 32 according to the embodiments described above, will be described with reference to FIG. 12, FIG. 13, and FIG. 14. FIG. 12, FIG. 13, and FIG. 14 each shows a graph representing shift of the driving torque TR (vertical axis) plotted against a driving time (horizontal axis).

FIG. 12 shows shift of the driving torque TR in the case of the driving torque TR being advantageously restored according to the embodiments described above. In FIG. 12, in a time period from time T10 to time T11, the driving torque TR stably shifts so as to indicate a value less than the threshold value TR(C) as described above. On the other hand, some electrical error occurs at time T11, and a great amount of toner to be discarded starts to enter the collecting housing 30H. As a result, increase of the driving torque TR of the driving motor 32 is started. When the driving torque TR becomes greater than the threshold value TR(A) (time T12), the image forming condition adjustment portion 94 executes checking and correction of the image forming condition. When the image forming condition is advantageously corrected, and an amount of toner to be discarded, which enters the collecting housing 30H, is reduced, the driving torque TR is reduced. When the driving torque TR becomes less than the threshold value TR(C) (time T13), the printing operation is stably executed after that (time T14). Therefore, the image forming apparatus 1 is provided which can perform the image forming operation as continuously as possible.

On the other hand, FIG. 13 shows a state where the driving torque TR shifts when correction of the image forming condition is not performed by the image forming condition adjustment portion 94, or when an amount of toner to be discarded, which enters the collecting housing 30H, is not reduced although the correction is executed. As in FIG. 12, when the driving torque TR becomes greater than the threshold value TR(A), the image forming condition adjustment portion 94 executes checking of the image forming condition (time T22). When the image forming condition conforms to the set condition having been preset, and the image forming condition need not be corrected, the driving torque TR continues to increase. When the driving torque TR reaches the threshold value TR(B), the image formation control portion 91 halts printing operation, and warning information is indicated on the display portion 101.

Further, FIG. 14 shows a state where the driving torque TR shifts when, in the case of the image forming operation being temporarily stopped, the conveying member 31 continues to be driven and thus the driving torque TR is temporarily reduced, but the driving torque TR increases again. As in FIG. 13, when the driving torque TR becomes greater than the threshold value TR(A), the image forming condition adjustment portion 94 executes checking of the image forming condition (time T32). Also when the image forming condition conforms to the set condition having been preset, and the image forming condition need not be corrected, the driving torque TR may be temporarily reduced due to the conveying member 31 being driven (time T33). However, when the image forming operation is restarted, a great amount of toner to be discarded enters the collecting housing 30H again, and the driving torque TR reaches the threshold value TR(B) (time T34). In this case, the image forming operation is halted and warning information is indicated on the display portion 101 as described above, thereby realizing restoration operation of the collecting device 30.

Thus, the image forming apparatus 1 according to the embodiments of the present disclosure is described above. However, the present disclosure is not limited thereto. For example, modifications described below may be implemented.

(1) In the first embodiment described above, a set value of a developing bias is checked and updated by the image forming condition adjustment portion 94. However, the present disclosure is not limited thereto. A set value of a charging bias applied to the charging roller 123A, or a set value of an amount of laser light (exposure) that is preset for laser light applied from the exposure device 124 may be similarly checked and corrected by the image forming condition adjustment portion 94.

Figure 15:
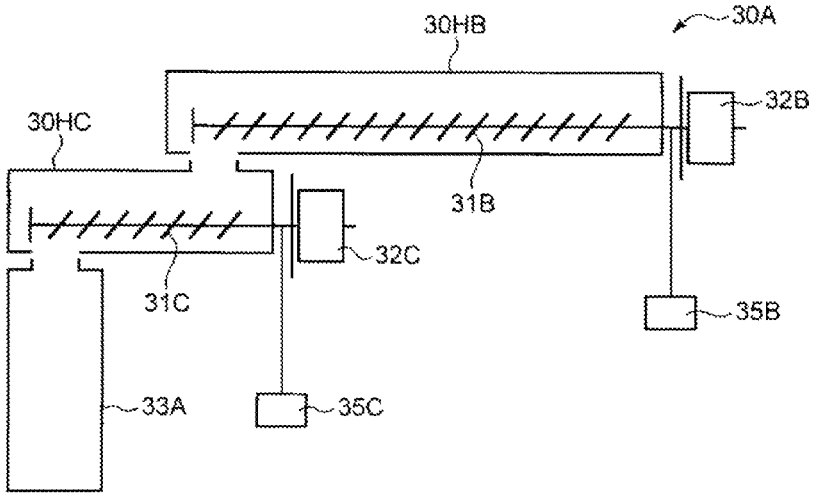
FIG. 15 is a cross-sectional view schematically illustrating a collecting device according to another embodiment of the present disclosure.

(2) Further, in the embodiments described above, the number of the conveying members 31 included in the collecting device 30 is one. However, the present disclosure is not limited thereto. FIG. 15 is a schematic diagram illustrating a structure of a collecting device 30A according to the present modification. The collecting device 30A includes, as a plurality of conveying members, a conveying member 31B and a conveying member 31C that are connected in series. The conveying member 31B is disposed in a collecting housing 30HB, and the conveying member 31C is disposed in a collecting housing 30HC. The conveying member 31B and the conveying member 31C are connected to a driving motor 32B and a driving motor 32C, respectively. The driving motor 32B and the driving motor 32C rotation-drive the conveying member 31B and the conveying member 31C, respectively. Further, a torque sensor 35B and a torque sensor 35C detect a driving torque TR1 of the driving motor 32B and a driving torque TR2 of the driving motor 32C, respectively. Toner to be discarded, which enters the collecting housing 30HB on one end side of the collecting housing 30HB, is conveyed, by the conveying member 31B, toward the other end side of the collecting housing 30HB, and enters the collecting housing 30HC. The toner to be discarded is conveyed by the conveying member 31C, to enter the collecting container 33A.

Also in such a structure, checking and correction of the image forming condition by the image forming condition adjustment portion 94, and temporary stopping and restarting of the image forming operation by the image formation control portion 91 are advantageously controlled based on shift of the driving torque TR1 or the driving torque TR2. Checking and correction of the image forming condition may be executed based on one of the driving torque TR1 or the driving torque TR2, or may be executed based on both of the driving torque TR1 and the driving torque TR2.

When the checking and correction of the image forming condition is executed based on one of the driving torque TR1 or the driving torque TR2, temporary stopping and restarting of the image forming operation are controlled based on shift of the driving torque TR1 of the conveying member 31B disposed on the upstream side, thereby enabling the collecting device 30A to be early restored. Further, if the driving torque TR1 reaches the threshold value TR(B), and the conveying member 31B is damaged, damage of the conveying member 31C can be prevented.

(3) Further, in the embodiments described above, when, in FIG. 11, the sheet input information Pdata (A) and the image size information Idata having been preset do not match (YES in step S033), the image forming condition adjustment portion 94 selects the sheet feed cassette 142B represented by the sheet input information Pdata (B) other than the sheet input information Pdata (A), thereby updating the sheet input information Pdata (step S034, corresponding to step S108 in FIG. 9). However, the present disclosure is not limited thereto. When the sheet input information Pdata (A) and the image size information Idata having been preset do not match (YES in step S033), the image formation control portion 91 may halt the image forming operation in a state where a result indicating that they do not match is indicated on the display portion 101. Thus, warning is immediately issued by indicating, on the display portion 101, the comparison result that the image size information Idata and the sheet input information Pdata do not match, and the image forming condition is abnormal.

Figure 16:
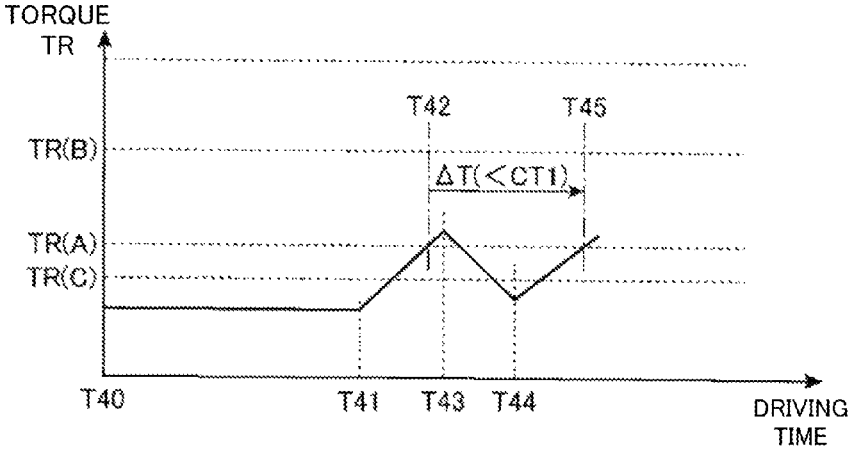
FIG. 16 shows a graph representing shift of torque of the conveying member in the case of the image forming condition adjustment operation according to another embodiment of the present disclosure being performed.

(4) Further, in the embodiments described above, with reference to FIG. 14, a state is described where the driving torque TR shifts when, in the case of the image forming operation being temporarily stopped, the conveying member 31 continues to be driven and thus the driving torque TR is temporarily reduced, but the driving torque TR increases again. However, the present disclosure is not limited thereto. FIG. 16 shows a graph representing shift of the driving torque TR according to a modification of the present disclosure. In the present modification, when the driving torque TR becomes greater than the threshold value TR(A) at time T42, the image forming condition adjustment portion 94 executes checking of the image forming condition. Also when the image forming condition conforms to the set condition having been preset, and the image forming condition need not be corrected, the driving torque TR is temporarily reduced due to the conveying member 31 being driven (time T43). However, when the image forming operation is restarted, a great amount of toner to be discarded enters the collecting housing 30H again, and increase of the driving torque TR starts (time T44). Thereafter, the driving torque TR reaches the threshold value TR(A) again. In the present modification, when a period ΔT from time T42 when the driving torque TR reaches the threshold value TR(A) for the first time, to time T45 when the driving torque TR reaches the threshold value TR(A) for the second time, is shorter than a preset check time CT1, the image formation control portion 91 halts the printing operation and indicates warning information on the display portion 101. In other words, in a case where the driving torque TR becomes greater than the threshold value TR(A) again in a predetermined time period after the image forming operation is restarted, the image formation control portion 91 halts the image forming operation. Therefore, a possibility of reoccurring of increase of the drive load can be early detected to halt the image forming operation, thereby advantageously preventing damages of the conveying member 31 and the driving motor 32. The control described above may be performed also when the image forming condition adjustment portion 94 executes correction of the image forming condition. Further, a time when measurement of the period ΔT is started may be a time when the image forming operation is restarted.

Figure 17:
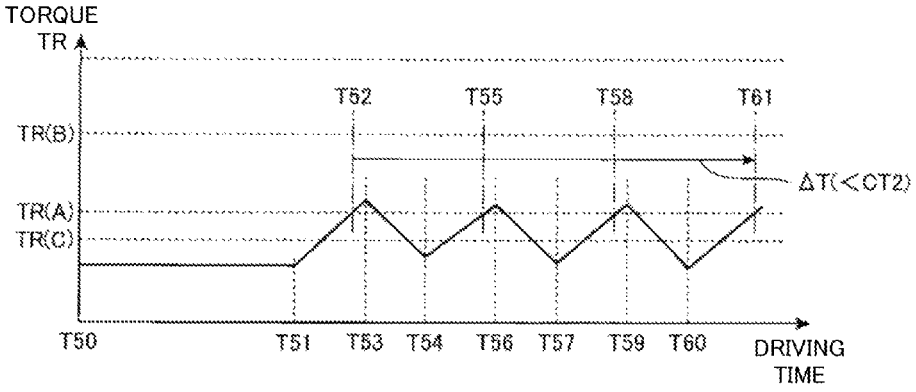
FIG. 17 shows a graph representing shift of torque of the conveying member in the case of the image forming condition adjustment operation according to still another embodiment of the present disclosure being performed.

(5) Further, FIG. 17 shows a graph representing shift of the driving torque TR according to another modification of the present disclosure. In the present modification, when the driving torque TR becomes greater than the threshold value TR(A) at time T52, the image forming condition adjustment portion 94 executes checking of the image forming condition. Also when the image forming condition conforms to the set condition having been preset, and the image forming condition need not be corrected, the driving torque TR is temporarily reduced due to the conveying member 31 being driven (time T53). However, when the image forming operation is restarted, a great amount of toner to be discarded enters the collecting housing 30H again, and increase of the driving torque TR starts (time T54). Thereafter, the driving torque TR reaches the threshold value TR(A) again (time T55). In a case where a cause by which a great amount of toner to be discarded is generated is not eliminated, shift of the driving torque TR between the threshold value TR(C) and the threshold value TR(A) is repeated plural times in a time period from time T51 to time T61 as shown in FIG. 17. In the present modification, when the number of times the driving torque TR is temporarily reduced so as to be less than the threshold value TR(C), and thereafter reaches the threshold value TR(A) again, is three in a preset check time CT2, the image formation control portion 91 halts the printing operation, and indicates warning information on the display portion 101. Namely, in a case where, after the image forming operation is restarted, the number of times the driving torque TR becomes greater than the threshold value TR(A) and then becomes less than the threshold value TR(C), is greater than or equal to a predetermined number of times in a preset time period, the image formation control portion 91 halts the image forming operation. Thus, a possibility of reoccurring of increase of drive load can be early detected, to halt the image forming operation. The control described above may be performed also when the image forming condition adjustment portion 94 executes correction of the image forming condition. Further, the number of times the driving torque TR shifts between the threshold value TR(C) and the threshold value TR(A) is not limited to three. The number of times the driving torque TR shifts between the threshold value TR(C) and the threshold value TR(A) may be any predetermined plural number of times. Further, measurement of the period ΔT may be started at a time when the image forming operation is restarted.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion that includes: an image carrier on which a toner image is carried; a transfer portion which transfers the toner image to a sheet; and a cleaning portion which cleans the image carrier to remove toner being left on the image carrier after transfer, wherein the image forming portion executes an image forming operation on a sheet, a toner-disposal container that stores the toner to be discarded;

a conveying portion that conveys the toner to be discarded, from the cleaning portion, to the toner-disposal container;

a driving portion that drives the conveying portion;

a load detection portion that detects a drive load on the driving portion;

an image forming condition adjustment portion that checks an image forming condition of the image forming operation, and corrects, when the image forming condition does not conform to a predetermined condition, the image forming condition; and an image formation control portion that controls the driving portion and the image forming operation, wherein in a case where the drive load detected by the load detection portion becomes greater than a first threshold value while the conveying portion is driven by the driving portion and the image forming operation is executed, the image formation control portion temporarily stops the image forming operation, causes the image forming condition adjustment portion to check and correct the image forming condition, and restarts the image forming operation when, according to the image forming condition having been corrected, the drive load becomes less than a second threshold value which is less than the first threshold value.

2. The image forming apparatus according to claim 1, wherein the image formation control portion halts the image forming operation when the drive load becomes greater than a third threshold value which is greater than the first threshold value.

3. The image forming apparatus according to claim 1, wherein the conveying portion includes a plurality of conveying members, the driving portion includes a plurality of driving portions which drive the plurality of conveying members, respectively, and the image formation control portion temporarily stops and restarts the image forming operation based on the drive load of at least one of the plurality of driving portions.

4. The image forming apparatus according to claim 1, wherein the image carrier is a photosensitive drum which is driven to rotate, the image forming portion includes: a developing roller which carries toner, and supplies the toner to the photosensitive drum; and a developing bias application portion which applies a developing bias to the developing roller, and generates a difference in potential between the developing roller and the photosensitive drum, and the image forming condition adjustment portion checks and corrects a set value of the developing bias.

5. The image forming apparatus according to claim 1, wherein the image carrier is a photosensitive drum that is driven to rotate, the image forming portion includes: a charging portion which charges a surface of the photosensitive drum; and a charging bias application portion which applies a charging bias to the charging portion, and the image forming condition adjustment portion checks and corrects a set value of the charging bias.

6. The image forming apparatus according to claim 1, wherein the image carrier is a photosensitive drum that is driven to rotate, the image forming portion includes an exposure portion which exposes a surface of the photosensitive drum with a predetermined exposure to form an electrostatic latent image on the surface, and the image forming condition adjustment portion checks and corrects a set value of the exposure.

7. The image forming apparatus according to claim 1, wherein the image formation control portion halts the image forming operation in a case where, after the image forming operation is restarted, the drive load becomes greater than the first threshold value again in a preset time period.

8. The image forming apparatus according to claim 1, wherein the image formation control portion halts the image forming operation in a case where, after the image forming operation is restarted, the number of times the drive load becomes greater than the first threshold value and then becomes less than the second threshold value, is greater than or equal to a predetermined number of times in a preset time period.

9. An image forming apparatus comprising:

an image forming portion that includes: an image carrier on which a toner image is carried; a transfer portion which transfers the toner image to a sheet; and a cleaning portion which cleans the image carrier to remove toner being left on the image carrier after transfer, wherein the image forming portion executes an image forming operation on a sheet, a toner-disposal container that stores the toner to be discarded;

a conveying portion that conveys the toner to be discarded, from the cleaning portion, to the toner-disposal container;

a driving portion that drives the conveying portion;

a load detection portion that detects a drive load on the driving portion;

an image forming condition adjustment portion that checks an image forming condition of the image forming operation, and corrects, when the image forming condition does not conform to a predetermined condition, the image forming condition; and an image formation control portion that controls the driving portion and the image forming operation, wherein in a case where the drive load detected by the load detection portion becomes greater than a first threshold value while the conveying portion is driven by the driving portion and the image forming operation is executed, the image formation control portion temporarily stops the image forming operation, causes the image forming condition adjustment portion to check the image forming condition, and restarts the image forming operation when the image forming condition has been corrected.

10. The image forming apparatus according to claim 9, wherein the image formation control portion halts the image forming operation when the drive load becomes greater than a third threshold value which is greater than the first threshold value.

11. The image forming apparatus according to claim 9, wherein the conveying portion includes a plurality of conveying members, the driving portion includes a plurality of driving portions which drive the plurality of conveying members, respectively, and the image formation control portion temporarily stops and restarts the image forming operation based on the drive load of at least one of the plurality of driving portions.

12. The image forming apparatus according to claim 9, wherein the image formation control portion halts the image forming operation in a case where the image forming condition is not corrected by the image forming condition adjustment portion.

13. The image forming apparatus according to claim 9, further comprising:

a sheet cassette in which the sheet is stored;

an input portion in which image size information for the toner image and sheet size information of the sheet stored in the sheet cassette, are previously inputted; and a storage portion that stores the image size information and the sheet size information, wherein the image forming condition adjustment portion checks the image forming condition by comparing the image size information and the sheet size information with each other.

14. The image forming apparatus according to claim 13, further comprising a display portion that displays warning information, wherein when the image size information and the sheet size information do not match, the image formation control portion causes the display portion to display a result of the comparison.

15. The image forming apparatus according to claim 13, wherein a plurality of the sheet cassettes are provided, and when the image size information and the sheet size information do not match, the image forming condition adjustment portion corrects the image forming condition by changing to a sheet cassette, among the plurality of the sheet cassettes, which stores a sheet which has a size matching with the image size information.

16. The image forming apparatus according to claim 9, wherein the image forming portion includes: a transfer portion which transfers the toner image from the image carrier to a sheet; and a transfer bias application portion that applies a transfer bias to the transfer portion, and the image forming condition adjustment portion checks and corrects a set value of the transfer bias.

17. The image forming apparatus according to claim 9, wherein the image formation control portion halts the image forming operation in a case where, after the image forming operation is restarted, the drive load becomes greater than the first threshold value again in a preset time period.

18. The image forming apparatus according to claim 9, wherein the image formation control portion halts the image forming operation in a case where, after the image forming operation is restarted, the number of times the drive load becomes greater than the first threshold value and then becomes less than a second threshold value that is less than the first threshold value, is greater than or equal to a predetermined number of times in a preset time period.

* * * * *